United States Patent [19]

Clark et al.

[11] 4,253,667

[45] Mar. 3, 1981

[54] GOLF BALL PUTTER

[76] Inventors: Jack L. Clark, 3389 Wrightview Pl.; William T. Naud, 4248 Lemp Ave., both of Studio City, Calif. 91604

[21] Appl. No.: 29,646

[22] Filed: Apr. 13, 1979

[51] Int. Cl.[3] ..... A63B 53/04

[52] U.S. Cl. ..... 273/168; 273/167 G; 273/171

[58] Field of Search ..... 273/77 R, 79, 80.1, 273/164, 167–175

[56] References Cited

U.S. PATENT DOCUMENTS

| | | | |
|---|---|---|---|
| D. 201,811 | 8/1965 | Kroll | 273/168 X |
| D. 231,373 | 4/1974 | Pavelle | 273/167 G X |
| 827,658 | 7/1906 | Paddock | 273/168 X |
| 1,511,479 | 10/1924 | Kelly et al. | 273/168 X |
| 1,518,316 | 12/1924 | Ellingham | 273/171 |
| 1,652,404 | 12/1927 | Graveure | 273/169 X |
| 1,703,199 | 2/1929 | McClure | 273/167 G X |
| 2,222,534 | 11/1940 | Harris | 273/168 X |
| 2,517,245 | 8/1950 | Scott | 273/171 |
| 3,037,770 | 6/1962 | Palmer | 273/167 G X |
| 3,042,405 | 7/1962 | Solheim | 273/168 X |
| 3,758,115 | 9/1973 | Hoglund | 273/167 G X |
| 3,819,180 | 6/1974 | Murphy | 273/167 F X |
| 4,010,958 | 3/1977 | Long | 273/169 |

FOREIGN PATENT DOCUMENTS

| | | | |
|---|---|---|---|
| 8336 | of 1906 | United Kingdom | 273/168 |
| 242756 | 11/1925 | United Kingdom | 273/169 |
| 402079 | 11/1933 | United Kingdom | 273/169 |
| 727051 | 3/1955 | United Kingdom | 273/169 |

*Primary Examiner*—Richard J. Apley
*Attorney, Agent, or Firm*—Allan D. Mockabee

[57] ABSTRACT

A golf ball putter wherein the mass of the putter head is distributed along the line of swing or stroke of the putter as distinguished from distribution of the mass of the putter head transversely to the line of the stroke of the club, the shaft being connected to the head at a point centrally of the length and width of the head, the head having a striking face defined by a transversely extending web which projects laterally of the main body of the head, the principal mass of the putter head being confined to said main body, the lateral extent of the striking face relative to the main body being such that a golf ball is engaged by a "sweet spot" throughout a major transverse extent of the striking surface, the head being provided with a cavity for weighted elements such as shot held in place by a matrix, and the cavity being closed by a rectangular panel extending longitudinally of the lie of stroke of the putter in a direction normal to the striking face and comprising an aiming stripe.

3 Claims, 5 Drawing Figures

GOLF BALL PUTTER

FIELD OF THE INVENTION

The invention lies in the field of golf clubs and more specifically putters used for striking and propelling a golf ball across a putting green. to the cup.

The invention relates to a putter having a head with a main body portion and one or two laterally extending webs which define striking surfaces which face in opposite directions and render the putter equally useful to right-handed or left-handed golfers.

Insofar as known to us, golf ball putters have the weight of their heads distributed mainly transversely to the line of stroke of the putter, whereas, in the present invention, the mass is mainly distributed along the line of stroke, the head being elongated along said line of stroke and thereby greatly assisting lining up of the putter along the intended line.

The transverse putting surface web is relatively short compared to conventional putters and the major mass of the head is in a main body portion which is concentrated in a median area of the striking face. The transverse extent of the striking face being reduced compared to conventional putters, bringing the mass of the main body portion behind a substantial area of the striking face, results in a more effective "sweet spot" throughout most of the transverse length of the striking face.

The putter head is provided with an upwardly open cavity which is symmetrically shaped and located in the head and is adapted to receive discrete weight elements such as lead pellets uniformly distributed in the cavity and held in position by a suitable matrix. Then the cavity is covered, preferably by a rectangular plate, the cavity and the plate being elongated in the direction of swing of the putter in a putting stroke. Thus the cover plate for the cavity also serves as an aiming strike to facilitate lining up of the putter on the desired line of stroke.

The above and other objects of the invention will more fully appear from the following description in connection with the accompanying drawing.

The drawings illustrate a putter head 6 having a main body portion 8 and a pair of spaced, oppositely facing and laterally extending webs 10 whose outer sides comprise striking faces 12 adapted to contact a golf ball in the putting stroke. Oppositely facing striking faces are provided so that the club can be used by right-handed or left-handed persons.

Figure 3:
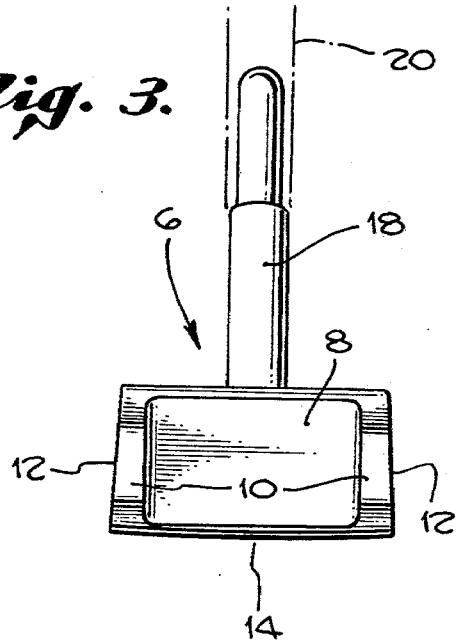
FIG. 3 is an elevational view taken 90 degrees to that of FIG. 1.
Figure 4:
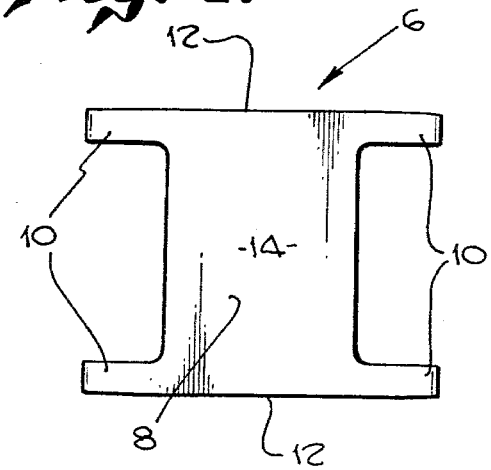
FIG. 4 is a bottom plan view.

The bottom 14 of the main body portion 8 of the head is convex to permit the putter to rest on the surface of the green with approximately the same amount of contact even though the individual user may hold the club at a different angle from that of another golfer. It should be noted that the undersides of the laterally extending webs 10 which define the striking faces 12 are formed on continuations of the curve of the underside 14 of the main body portion 8. Furthermore, as viewed in FIG. 3, the underside of the head of the putter is curved at right angles to the curvature shown in FIGS. 1 and 5. The curvature shown in FIG. 3 may be comparable to the arc of swing of the putter in use and this curvature is provided to assist in preventing the golfer from catching the bottom leading edge of the putterhead on the surface of the green during the putting stroke.

It should be noted that the transverse width of the main body portion 8 of the putting head is a considerable percentage of the length of the striking face 12 as determined by the transverse extent of the webs 10. Thus the mass of the main body portion 8, while intended to be concentrated inwardly from the tips of the webs 10, has an appreciable distribution of weight transversely of the putterhead so that, unless the ball is struck at the extreme end of the striking face 12, the striking face has a "sweet spot" which for all practical purposes, extends nearly the full length of the striking face. Thus, while the effective mass of the putterhead is concentrated in medial portions of the striking face, at the same time the effective "sweet spot" is spread a considerable distance laterally.

Figure 1:
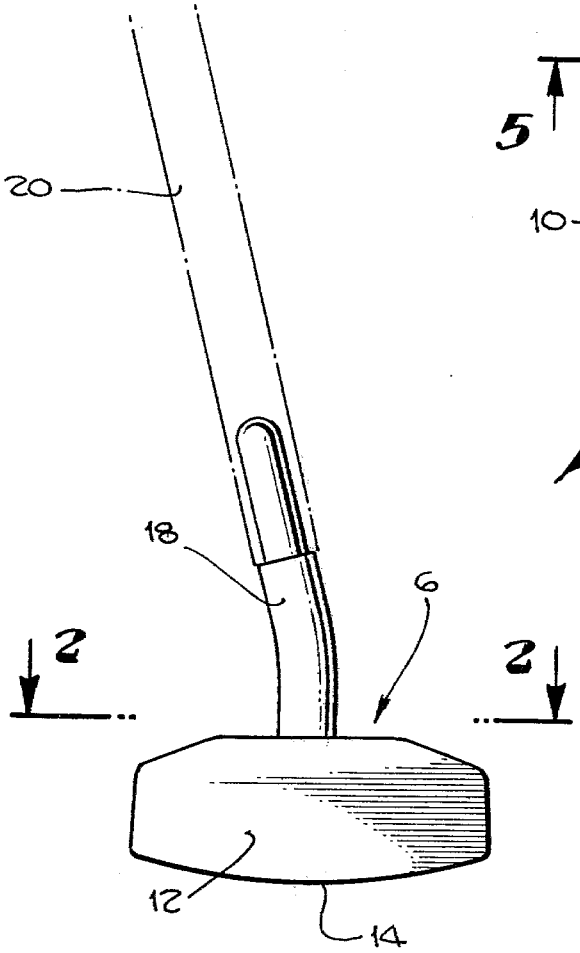
FIG. 1 is an elevational view of an embodiment of the invention, the shaft of the putter being indicated in broken lines.
Figure 2:
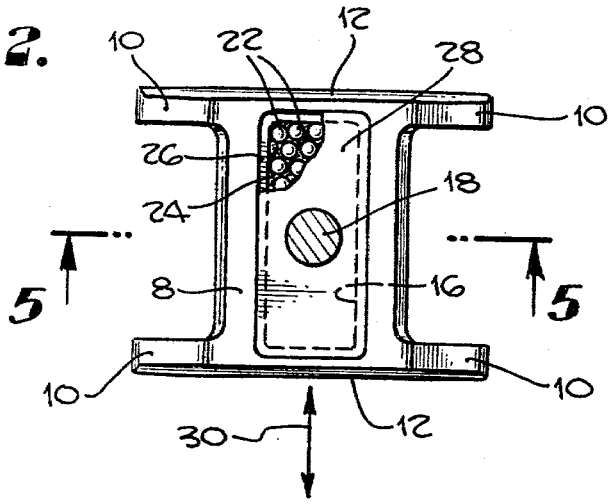
FIG. 2 is a section taken approximately on line 2—2 of FIG. 1 with portions broken away to show interior structure.
Figure 5:
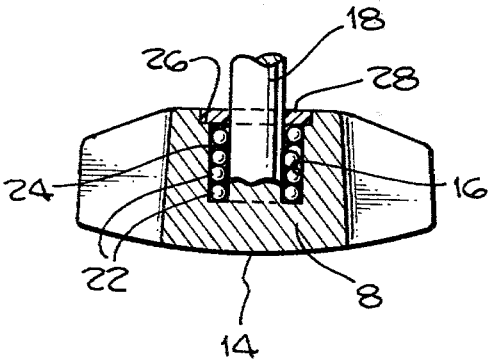
FIG. 5 is a section taken approximately on the line 5—5 of FIG. 2.

The main body portion 8 is provided with an upwardly open cavity 16 from which a shank 18 extends upwardly and is angled as shown in FIG. 1. As shown in FIGS. 2 and 5 the shank 13 is connected to the head at its longitudinal and lateral or horizontally symmetrical center to provide balanced suspension of said head. A conventional shaft 20 is secured and extends upwardly from the shank 18.

Within the cavity 16 are discrete weight elements 22 which preferably are in the form of round lead shot. They are uniformly distributed throughout the cavity 16 and are held in position by a suitable matrix 24, preferably an epoxy. By varying the number of weight elements 22, the swing weight of the putter can be varied, and the same number of weight elements can be placed in successive club heads to provide uniform classes of swing weights, such as light, medium or heavy.

The cavity 16 is rabbeted as indicated at 26 to receive a closure plate 28 which conveniently may be made of plastic and secured in the rabbet 26 with an epoxy. The closure plate, as shown in FIG. 2, is elongated in the direction of stroke of the club, said direction being indicated by the arrow 30. Also the closure can be of a color distinguished from that of the putterhead to provide a highly efficient aiming stripe to assist the golfer in lining up the putterhead with the desired line of his put. This aiming stripe, particularly in conjunction with the striking faces 12, the later being normal to the direction of the putting stroke, provides a simply yet highly efficient aiming device which adds materially to the accuracy of the putt.

It will of course be understood that changes can be made in the specific form and arrangement of the device without departing from the spirit of the invention.

What is claimed is:

1. A golf ball putter comprising: a shaft, a club head having a primary body portion and a striking face extending laterally from said body portion at the front and rear therof, said body portin being elongated longitudinally of the line of stroke of the putter and being longer in its longitudinal dimension than in its lateral dimension, the lateral dimension of said body portion being a substantial portion of the lateral dimension of said club head, said body portion having its mass extending in its longitudinal directin and concentrated behind medial portions of said striking faces and inwardly from both ends of said striking faces, said body portion having its center of gravity located at the longitudinal and lateral center of said club head, each of said striking faces having a medial portion coextensive with the lateral dimension of said body portion and possessing coplanar extensions defined by free ending webs located laterally beyond said body portion in opposite directions and being of equal length thereby forming with said body portion a club head shaped in the form of a symmetrical 'letter' "H", and said shaft having its lower end connected at a point on a line vertically above said center of gravity.

2. A golf ball putter in accordance with claim 1 wherein a longitudinally extending cavity is provided in said body portion, a variable number of weight elements in said cavity, and said weight elements being concentrated behind said medial portions of said striking faces.

3. A golf ball putter in accordance with claim 1 wherein the bottom surfaces of said body portions and said striking faces define a common radial arc generated transversely to the longitudinal dimension of the club head.

* * * * *